US009631419B1

(12) United States Patent
Hartley

(10) Patent No.: US 9,631,419 B1
(45) Date of Patent: Apr. 25, 2017

(54) DOOR BARRICADE

(71) Applicant: Alan Wayne Hartley, Centennial, CO (US)

(72) Inventor: Alan Wayne Hartley, Centennial, CO (US)

( * ) Notice: Subject to any disclaimer, the term of this patent is extended or adjusted under 35 U.S.C. 154(b) by 0 days.

(21) Appl. No.: 14/938,992

(22) Filed: Nov. 12, 2015

(51) Int. Cl.

| | |
|---|---|
| ***E06B 5/11*** | (2006.01) |
| ***E05B 17/20*** | (2006.01) |
| ***G09F 7/00*** | (2006.01) |
| *G09F 7/18* | (2006.01) |

(52) U.S. Cl.
CPC ..... *E06B 5/11* (2013.01); *E05B 17/2084* (2013.01); *G09F 7/00* (2013.01); *G09F 2007/1843* (2013.01); *G09F 2007/1856* (2013.01)

(58) Field of Classification Search
CPC ..... G09F 7/18; G09F 7/00; G09F 3/20; G09F 15/00; G09F 1/10; G09F 7/08; G09F 23/06; G09F 7/10; G09F 15/0056; G09F 3/18; G09F 15/0012; G09F 2007/1843; G09F 3/201; G09F 1/12; G09F 15/0006; G09F 2007/1856; G09F 1/02; G09F 2013/045; E06B 5/11; E05B 17/2084
USPC ..... 109/76; 292/259 R, 288, 289; 49/56, 49/506
See application file for complete search history.

(56) References Cited

U.S. PATENT DOCUMENTS 1,369,550 A * 2/1921 Scharf ..... G09F 7/00 40/651
1,865,182 A * 6/1932 Futch ..... G09F 1/12 40/594
4,074,552 A * 2/1978 Smith ..... E05B 17/2084 70/417
4,703,575 A * 11/1987 Diamond ..... G09F 3/20 211/DIG. 1
4,763,499 A * 8/1988 Boyle ..... E05B 17/2084 16/319
4,939,866 A * 7/1990 Kluge ..... E06B 9/01 160/225
5,079,886 A * 1/1992 Downs ..... B44F 1/063 52/202
5,154,461 A * 10/1992 Prescott ..... E05B 17/2084 292/272
5,388,359 A * 2/1995 DeWitt ..... G09F 7/18 248/231.71
5,461,827 A * 10/1995 Lofton ..... E06B 9/02 49/55
5,487,237 A * 1/1996 Martin, Jr. ..... E06B 9/01 49/395
5,586,796 A * 12/1996 Fraser ..... E05B 15/0205 292/340

(Continued)

FOREIGN PATENT DOCUMENTS

GB 2205886 A * 12/1988 ..... E06B 3/92
GB 2306544 * 7/1997 ..... E06B 5/11

*Primary Examiner* — Suzanne Barrett
(74) *Attorney, Agent, or Firm* — Dunlap Bennett & Ludwig PLLC

(57) ABSTRACT

A door barricade is provided. The door barricade includes a metal plate having a substantially planar inside surface and outside surface. The metal plate includes at least one receiving flange protruding from at least one of the inside surface and the outside surface. A sign with indicia is releasably retained within the receiving flange. The metal plate is secured to a door, thereby preventing burglars from entering.

8 Claims, 3 Drawing Sheets

(56) References Cited

U.S. PATENT DOCUMENTS

| | | | | | |
|---|---|---|---|---|---|
| 5,802,765 | A * | 9/1998 | Vickery | E06B 9/02 | 49/460 |
| 5,910,076 | A * | 6/1999 | Gladney | E06B 9/04 | 49/55 |
| 5,934,020 | A * | 8/1999 | McCracken | E06B 9/04 | 160/222 |
| 6,837,082 | B1 * | 1/2005 | Moore | E05B 17/2003 | 70/103 |
| D549,080 | S * | 8/2007 | Killins | D8/346 | |
| 8,756,883 | B2 * | 6/2014 | Glass | E06B 5/025 | 49/170 |
| 8,887,457 | B1 * | 11/2014 | Knight | E06B 1/52 | 49/504 |
| 2008/0263958 | A1 * | 10/2008 | Edson | E06B 7/30 | 49/56 |
| 2010/0075080 | A1 * | 3/2010 | Martin | G09F 1/10 | 428/35.6 |
| 2010/0300003 | A1 * | 12/2010 | Goode | E06B 3/72 | 49/504 |
| 2012/0241108 | A1 * | 9/2012 | Marszalek | E06B 9/18 | 160/264 |
| 2014/0026486 | A1 * | 1/2014 | Vavaris | E04G 21/3228 | 49/56 |
| 2015/0218878 | A1 * | 8/2015 | Olberding | E06B 7/16 | 49/394 |

* cited by examiner

DOOR BARRICADE

BACKGROUND OF THE INVENTION

The present invention relates to a door barricade and, more particularly, to a concealed door barricade to prevent buglers from entering through the door.

A majority of illegal entry into commercial businesses is accomplished by breaking glass of a door and entering below the handle.

As can be seen, there is a need for a structure that prevents intruders from breaking and entering into buildings.

SUMMARY OF THE INVENTION

In one aspect of the present invention, a door barricade comprises: a metal plate comprising an inside surface and an outside surface each being substantially planar, wherein a plurality of openings are formed through the metal plate that are positioned to correspond with a plurality of openings formed in a door; at least one receiving flange protruding from at least one of the inside surface and the outside surface; at least one sign releasably retained within the receiving flange, wherein the sign comprises an indicia; and a plurality of bolts operable to secure the metal plate to the door through the corresponding plurality of openings.

In another aspect of the present invention, a method of attaching a barricade to a door comprises: providing a door comprising a door frame and a glass plate disposed within the door frame running from a bottom end of the door frame to a top end of the door frame, wherein the door further comprises a handle disposed in between the top end and the bottom end; providing a metal plate comprising at least one receiving flange protruding from at least one of an inside surface and an outside surface and at least one sign releasably retained within the receiving flange, wherein the sign comprises an indicia; and bolting the metal plate to the door frame through a plurality of corresponding openings so that the metal plate is disposed in between the handle and the bottom end.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a metal shield partially hidden by advertising to deter illegal entry. The metal shield may be about two feet by two feet and may include a welded frame to hold an advertising medium. The metal shield is then mounted to a door, below the handle with bolts or screws. When the burglar breaks the glass window, the metal shield acts as a barrier to prevent entry below the door handle of the door.

Figure 2:
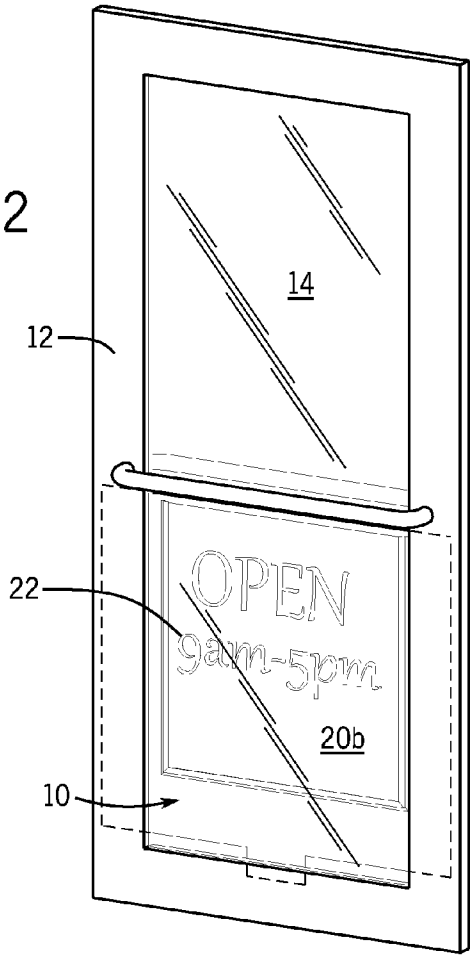
FIG. 2 is a rear perspective view of an embodiment of the present invention.
Figure 1:
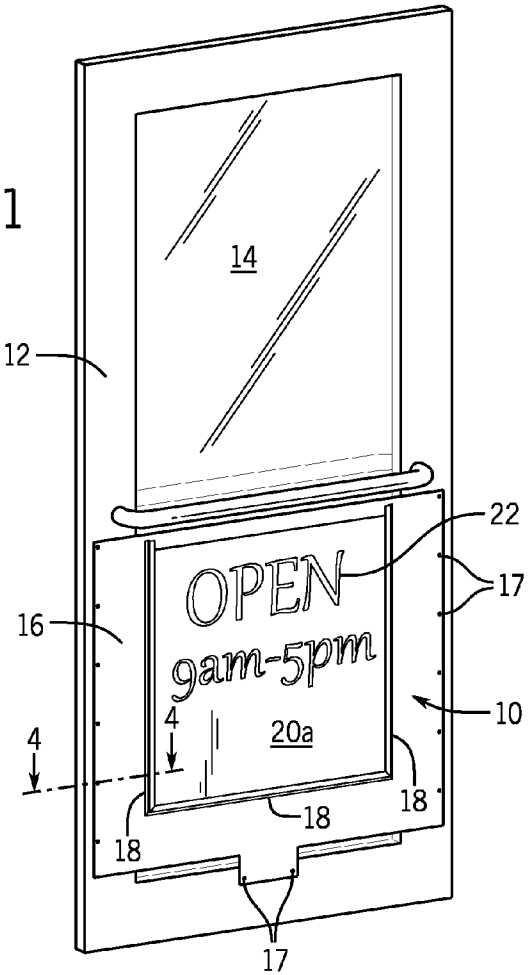
FIG. 1 is a front perspective view of an embodiment of the present invention.
Figure 3:
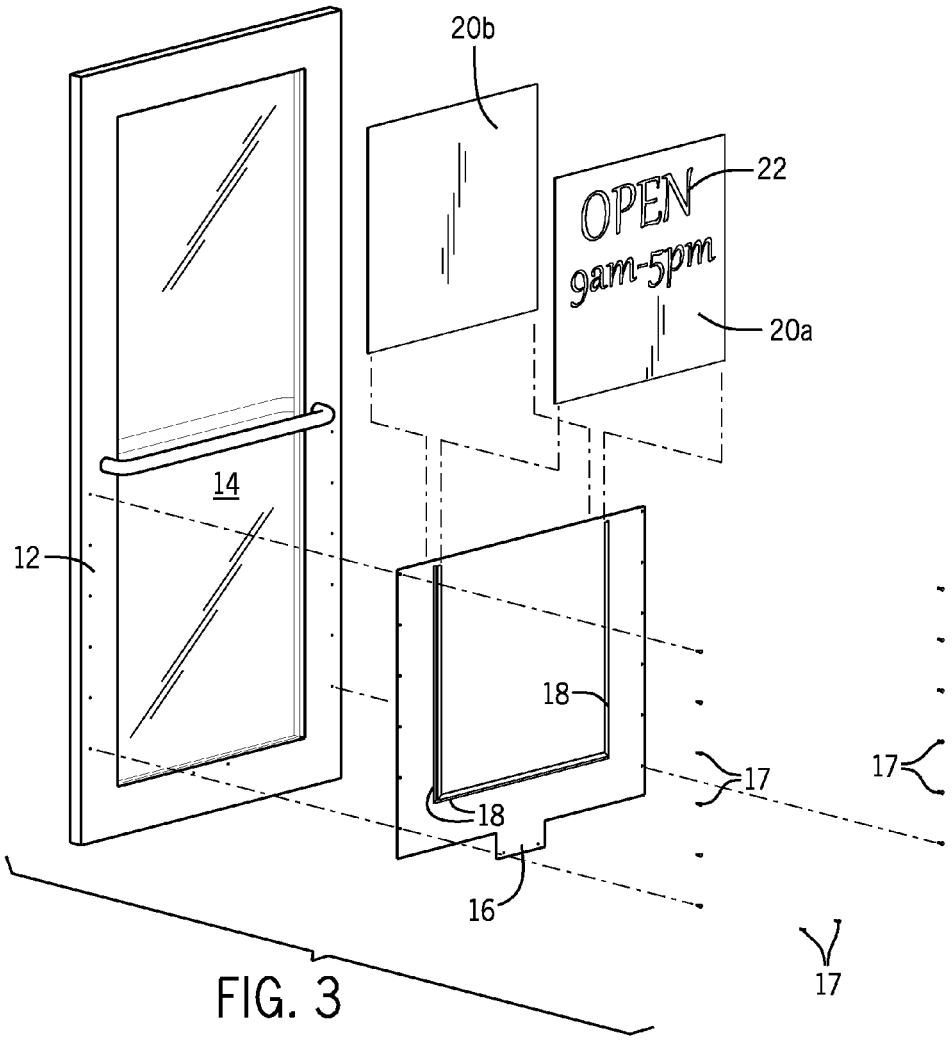
FIG. 3 is an exploded perspective view of an embodiment of the present invention.
Figure 4:
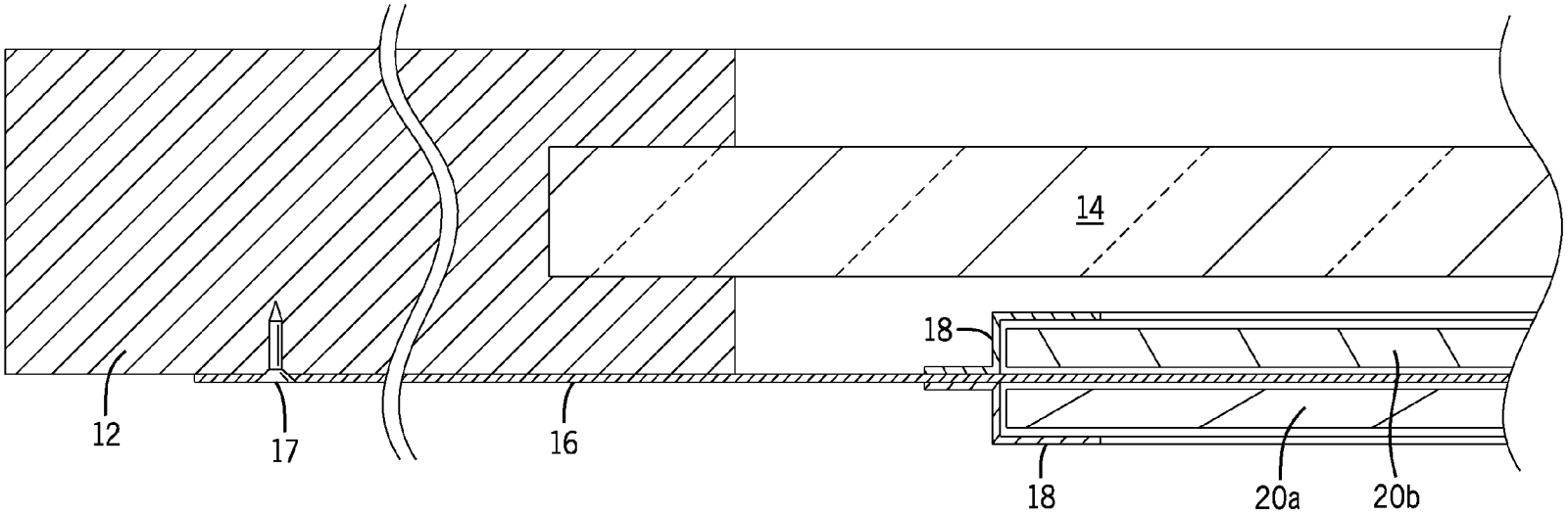
FIG. 4 is a cross-sectional view taken along line 4-4 in FIG. 1.

Referring to FIGS. 1 through 4, the present invention includes a door barricade 10. The door barricade 10 includes a metal plate 16 having a substantially planar inside surface and outside surface. The metal plate 16 includes at least one receiving flange 18 protruding from at least one of the inside surface and the outside surface. A sign 20*a*, 20*b* with indicia 22 is releasably retained within the receiving flange 18. The metal plate 16 is secured to a door 12, thereby preventing burglars from entering.

In certain embodiments, the metal plate 16 is secured to the door 12 using bolts 17 or screws. In such embodiments, a plurality of openings may be formed about the periphery of the metal plate 16. A plurality of openings may be formed in the door 12 that correspond with the plurality of openings formed through the metal plate 16. The bolts 17 or screws may run through the corresponding openings into the door 12, thereby securing the metal plate 16 to the door 12.

The receiving flange 18 of the present invention includes an L shaped cross section forming a channel sized to receive and secure the sign 20*a*, 20*b* within. In certain embodiments, the receiving flange 18 may include a bottom portion, a first side portion and a second side portion. The bottom portion may be substantially perpendicular to the first side portion and the second side portion. The first side portion and the second side portion may be substantially parallel relative to one another. The bottom portion joins the first side portion and the second side portion. The sign 20*a*, 20*b* may fit in between the first side portion, the second side portion and the bottom portion.

In certain embodiments, the present invention may include an inside receiving flange 18 secured to the inside surface of the metal plate 16 and an outside receiving flange 18 secured to the outside surface of the metal plate 16. In such embodiments, the present invention includes an inside sign 20*a* and an outside sign 20*b*. The inside sign 20*a* may be releasably retained within the inside receiving flange 18 and the outside sign 20*b* may be releasably retained within the outside receiving flange 18. Therefore, a sign 20*a*, 20*b* may be displayed on both sides of the metal plate 16.

The present invention may further include a method of attaching a barricade 10 to a door 12. The door 12 of the present invention may include a door frame with a glass plate 14. The glass plate 14 is disposed within the door frame and runs from a bottom end to a top end of the door frame. The door 12 further includes a handle disposed in between the top end and the bottom end of the door frame. The metal plate 12 mentioned above is bolted to the door 12 to cover a portion of the glass plate 14. The metal plate 16 is attached to the door frame to cover a bottom portion of the glass plate 14 in between the handle and the bottom end of the frame. The metal plate 16 may be attached to an inside surface of the door frame. Therefore, the outside sign 20*b* may be displayed through the glass plate 14 and the inside sign 20*a* may be displayed to individuals within the building. If a burglar or intruder tries to make entry by breaking the glass plate 14, the metal plate 16 prevents the burglar or intruder from entering the building.

It should be understood, of course, that the foregoing relates to exemplary embodiments of the invention and that modifications may be made without departing from the spirit and scope of the invention as set forth in the following claims.

What is claimed is:

1. A door barricade comprising:

a metal plate comprising an inside surface and an outside surface each being substantially planar, wherein a plurality of openings are formed through the metal plate that are positioned to correspond with a plurality of openings formed in a door;

an inside receiving flange secured to the inside surface;

an outside receiving flange secured to the outside surface;

at least one sign releasably retained within one of the inside receiving flange and the outside receiving flange, wherein the sign comprises an indicia; and a plurality of bolts operable to secure the metal plate to the door through the corresponding plurality of openings.

2. The door barricade of claim 1, wherein the at least one sign is an inside sign releasably retained within the inside receiving flange and an outside sign releasably retained within the outside receiving flange.

3. The door barricade of claim 1, wherein the at least one receiving flange comprises a bottom portion connecting a first side portion and a second side portion, wherein the first side portion and the second side portion are substantially parallel to each other.

4. The door barricade of claim 1, wherein the at least one receiving flange comprises an L shaped cross section.

5. A method of attaching a barricade to a door comprising:

providing a door comprising a door frame and a glass plate disposed within the door frame running from a bottom end of the door frame to a top end of the door frame, wherein the door further comprises a handle disposed in between the top end and the bottom end;

providing a metal plate comprising an inside receiving flange protruding from an inside surface of the metal plate and an outside receiving flange protruding from an outside surface of the metal plate and at least one sign releasably retained within one of the inside receiving flange and the outside receiving flange, wherein the sign comprises an indicia;

bolting the metal plate to the door frame through a plurality of corresponding openings so that the metal plate is covering a portion of the glass plate.

6. The method of claim 5, wherein the at least one sign is an inside sign releasably retained within the inside receiving flange and an outside sign releasably retained within the outside receiving flange.

7. The method of claim 5, wherein each of the inside receiving flange and the outside receiving flange comprises a bottom portion connecting a first side portion and a second side portion, wherein the first side portion and the second side portion are substantially parallel to each other.

8. The method of claim 5, wherein each of the inside receiving flange and the outside receiving flange comprises an L shaped cross section.

* * * * *